US008047455B2

(12) United States Patent
Reedy

(10) Patent No.: US 8,047,455 B2
(45) **Date of Patent: *Nov. 1, 2011**

(54) CORDLESS, SELF-CONTAINED, HANDHELD SPRAY GUN

(76) Inventor: Tony Reedy, Sanger, TX (US)

( * ) Notice: Subject to any disclaimer, the term of this patent is extended or adjusted under 35 U.S.C. 154(b) by 264 days.

This patent is subject to a terminal disclaimer.

(21) Appl. No.: 12/080,199

(22) Filed: Mar. 31, 2008

(65) Prior Publication Data

US 2010/0187335 A1 Jul. 29, 2010

Related U.S. Application Data

(63) Continuation-in-part of application No. 10/878,929, filed on Jun. 28, 2004, now Pat. No. 7,350,723.

(51) Int. Cl.
*B05B 7/02* (2006.01)
*B05B 1/28* (2006.01)

(52) U.S. Cl. ..... 239/296; 239/300; 239/308; 239/526; 239/DIG. 14

(58) Field of Classification Search ..... 239/290, 239/294, 296, 300, 302–304, 306–308, 332, 239/373, 376, 378, 526–528, DIG. 14; 118/683–685, 692, 712
See application file for complete search history.

(56) References Cited

U.S. PATENT DOCUMENTS

| | | | | |
|---|---|---|---|---|
| 3,236,459 | A * | 2/1966 | McRitchie | 239/416 |
| 4,030,665 | A * | 6/1977 | Koyama | 239/373 |
| 4,301,971 | A * | 11/1981 | Cornelius et al. | 239/351 |
| 6,402,058 | B2 * | 6/2002 | Kaneko et al. | 239/416.2 |
| 2002/0166902 | A1 * | 11/2002 | Pettit et al. | 239/296 |

* cited by examiner

*Primary Examiner* — Darren W Gorman

(57) ABSTRACT

What is disclosed is a self contained, cordless, handheld spray gun. The spray gun comprises a fluid container in intercommunication with at least one fluid nozzle orifice and a source of pressurized gas in intercommunication with at least one gas nozzle orifice and one fan nozzle orifice. The spray gun is actuated by pulling a trigger that actuates the gas flow to the nozzle and further actuation of which opens at least one valve so that the fluid, such as paint, primer, stain, varnish, sealant or the like, can flow to a fluid chamber, atomized, and sprayed through a fluid nozzle orifice out onto the article to be painted.

5 Claims, 2 Drawing Sheets

CORDLESS, SELF-CONTAINED, HANDHELD SPRAY GUN

CROSS REFERENCE TO RELATED APPLICATIONS

This application is a continuation-in-part of application Ser. No. 10/878,929, filed Jun. 28, 2004 now U.S. Pat. No. 7,350,723 entitled Cordless, self-contained, handheld spray gun.

FIELD OF THE INVENTION

The present invention generally pertains to spray guns and related devices adapted to spray fluids, such as paints, primers, stains, varnishes, sealants and the like. More specifically, but without restriction to the particular embodiment or use which is shown and described for purposes of illustration, the present invention relates to a cordless, self-contained, handheld spray gun.

BACKGROUND OF THE INVENTION

Electrically and pneumatically driven compressed air spray paint guns are well known. Such spray guns are used in the efficient painting of articles. These conventional spray paint guns are typically part of a painting system. These painting systems may include a tank or container in which the paint is stored and a pump which compresses air and delivers the air through a hose to the spray paint gun wherein the compressed air atomizes and forces the paint through a nozzle. Typically, the paint containers are located below the paint gun and paint is drawn through a tube into the gun handle or barrel to a chamber in communication with the nozzle. Pressure differentials are sometimes used to draw the paint or fluid to the chamber that is in communication with the nozzle. Paint containers are also sometimes located above the paint gun and liquid drawn through gravity or pressure differential, or a combination. Alternatively, paint or liquid may be drawn or pumped through a long tube into the paint gun from a tank that can located away from the paint gun. The amount of paint spray directed through the nozzle of the gun can be varied using a trigger coupled to a volume regulator. Adjusting a valve mechanism or pressure regulator is operable to vary the fan and amount of paint through the nozzle. There are certain disadvantages and limitations associated with using these conventional paint systems. The primary disadvantage is that the spray guns are tethered by long tubes adapted to transport either compressed air or paint or other fluid to the paint gun, greatly reducing their mobility.

Spray guns are well known in the art and such a typical gun is produced by Seta, though other manufactures produce similar gun apparatus. Such spray guns are typically connected through a long electrical cord to a compressor.

Cordless handheld power tools, such as cordless power drills, cordless power saws and cordless power sanders, including with interchangeable battery units, are widely known in the art. These cordless power tools were developed to allow the user thereof increased mobility in their use.

SUMMARY OF THE INVENTION

What is desired is a cordless, self-contained, handheld spray gun that allows the user thereof increased mobility when painting articles. The cordless, self-contained, handheld spray gun of the present invention is an integral, portable unit operable to atomize fluids of varying viscosities, such as paints, primers, stains, varnishes, sealants and the like. The cordless, self-contained, handheld spray gun is adapted to provide the user thereof with optimum mobility. The present invention comprises a cordless, self-contained, handheld spray gun. As described in more detail herein, fluid, such as paint, primer, stain, varnish, sealant or the like, through the force of gravity and/or assisted by air flow, is made to flow through a nozzle assembly. The spray gun is actuated by pulling a trigger that permits either air alone or air and liquid, such as paint, to be released from the fluid chamber onto a nozzle tip on a nozzle assembly. The application of a pressurized gas, such as air to the nozzle assembly having gas nozzle orifices and at least one fluid nozzle orifice, atomizes the fluid and directs to the article to be painted. The pressurized gas may be released to the nozzle assembly with or without the application of fluid through the nozzle assembly.

FIGURES OF THE INVENTION

For a better understanding of the present invention including its features, advantages and specific embodiments, reference is made to the following detailed description along with accompanying drawings in which.

DETAILED DESCRIPTION OF THE INVENTION

Figure 1:
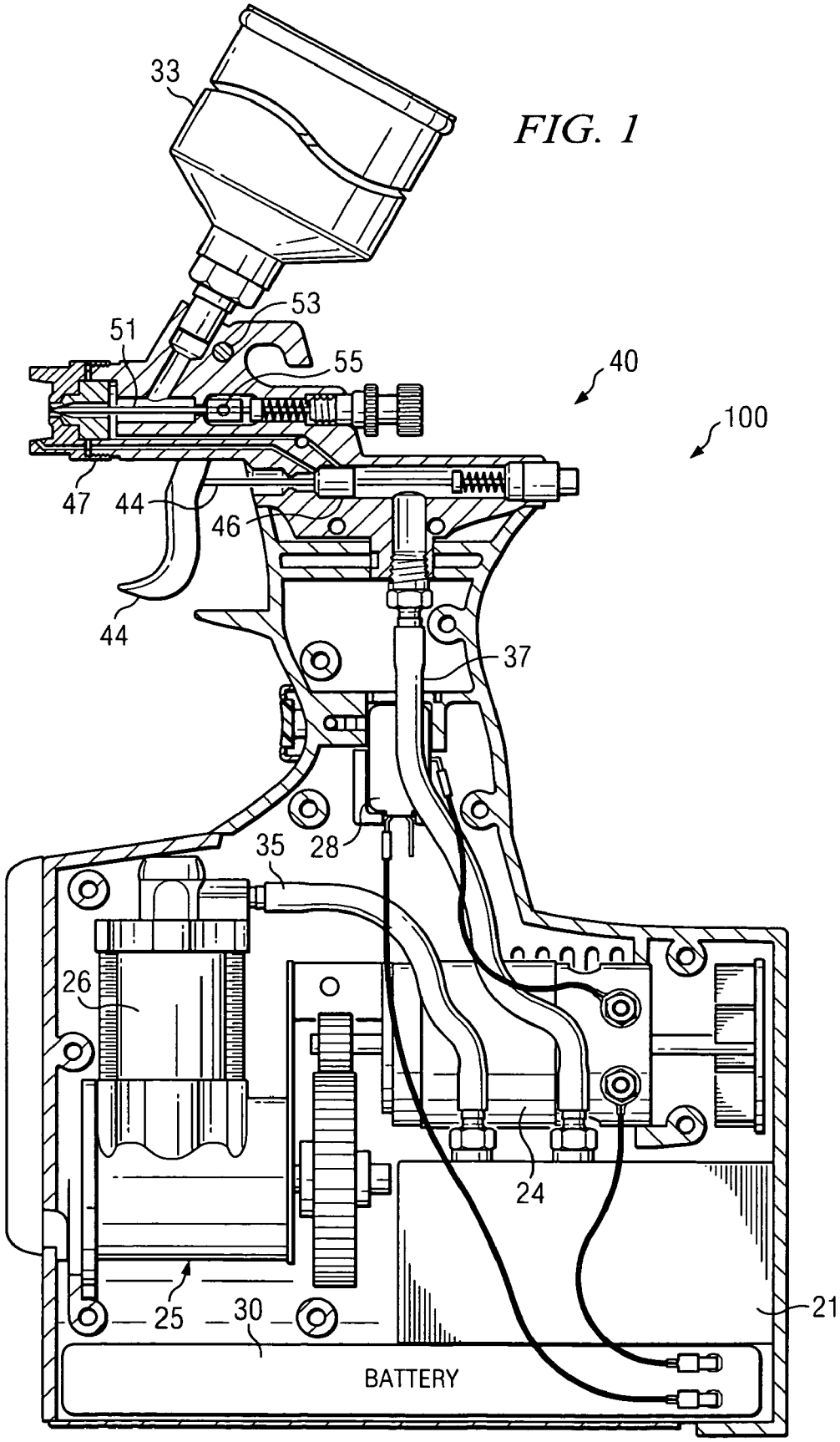
FIG. 1 depicts a cut-away side view of the cordless, self-contained, handheld spray gun of the present invention.

As seen in FIG. 1, the cordless, self-contained, handheld spray gun of the present invention has a typical gun body shape. More specifically, gun body has a barrel portion defined by a longitudinal first end, a longitudinal second end, a lateral first end, and lateral second end. Lateral second end has a base portion adapted to receive a source of power, such as a battery. Also formed in gun body is a paint container bore proximate the longitudinal first end through which an end of a paint container is disposed. A fluid nozzle assembly is formed at, and coupled to, the end of longitudinal first end. Fluid nozzle assembly can be adapted to be screwed onto the longitudinal first end. As seen in FIG. 1, an O-ring located between the fluid nozzle assembly and gun body is adapted to keep fluid, such as paint, from exiting between the fluid nozzle assembly and the gun body.

Gun body has a longitudinal central passage defined from the longitudinal first end to the longitudinal second end and a latitudinal central passage defined from the lateral first end to the lateral second end. Gun body also has a handle portion defined by an interval between the lateral first end and a lateral second end. The longitudinal first end and longitudinal second end are integral with, but orthogonal to said lateral first end and lateral second end. The longitudinal first end is located generally 90 degrees from the lateral second end.

Referring again to FIG. 1, nozzle assembly has a fluid nozzle orifice defined there-through. Nozzle assembly has a mechanism operable to adjust the amount and shape of the fluid drawn from fluid nozzle orifice. The mechanism comprises a valve member with a bore there-through, and an adjustable needle extending through the bore of valve member proximate fluid nozzle orifice. Adjustable needle can be adjusted to an open, partially open or closed position by adjusting fluid control knob. Fluid control knob is operable to manipulate the position of the adjustable needle in relation to a valve seat on valve member. Alternatively, the mechanism may includes a reciprocable valve member engageable with the valve seat to close the fluid nozzle orifice Further referring to FIG. 1, in gun body 100 is a reservoir of pressurized gas 21. The source of pressurized gas can be an electrically driven air compressor 25. As seen in FIG. 1, an electrically driven piston pump 26 is coupled through switch 28 to battery 30. The source of pressured gas may be designed or made adjustable to provide a variety of pressures, depending, for example, on the viscosity of the fluids to be ejected through the nozzle. For example, in one embodiment, the pressure may be no more than 10 psi so as to comply with certain EPA regulations concerning HVLP. In another embodiment, the pressure may be up to approximately 135 psi. The pressurized gas exits gas nozzle orifices and fan nozzle orifices and draws the fluid out of fluid chamber 33 through a fluid orifice and atomizes the fluid as a spray.

In the disclosed embodiment, the source of pressurized gas comprises an electrically driven air compressor system. Electrically driven compressor has a motor 24 with a means of transforming angular motion to linear motion, a piston pump comprising a piston, a piston chamber, and a system of intake and exhaust valves. A one way valve mechanism at output of the piston pump is operable to allow pressurized gas to exit the piston pump. In this manner, compressed gas can leave the piston chamber on each upward piston stroke, and is not drawn back into the chamber on each downward stroke.

Switch 28 is electrically connected, through battery 30, to motor 24, to turn on and off the compressor 25. When in the on position, air flows through first tube assembly 35 into reservoir 21, then out from air reservoir 21, through second tube assembly 37 to the spray gun head 40. Spray gun head 40 operates in a typical fashion in which a two-stage triggering mechanism is employed. As a user pulls trigger 42 slightly, needle 44 retracts stopper 46 to allow air flow though second tube assembly 37 through conduit 47 to the nozzle. As trigger 42 is pulled further, stopper 46 is drawn further back and allows air flow from second tube assembly to the nozzle and draws fluid. In addition, in this second stage of the trigger operation, second needle 51 is retracted and allows fluid to exit the nozzle assembly. The two stages are accomplished as trigger 42 is connected at pivot point 53 and is also connected to second needle 51 at connection point 55. As is know, air flow and pressure can be regulated through the adjustments shown on spray head 40.

As further seen in FIG. 1, a fluid container is located near the top of gun body. The container can have any variety of parallelepiped or cylindrical shapes, with a plurality of closed sides and an open top and a bottom with an opening therein. As used herein, the terms top, bottom and side are only meant to convey the general relative locations of these components with respect to each other. The use of these terms is not meant to necessarily imply a specific planar surface shape. The bottom of the fluid container is adapted to attach securely to the top of the gun body proximate the longitudinal first end, using a coupling means, such as at the container bottom being threaded and screwed onto a threaded inlet bore, or securely clamped thereon using a hose clamp mechanism, or snap in place mechanism. The means of coupling the fluid container to the gun body should create a seal between the fluid container and the inlet bore of the gun body so as to prevent leaks of the fluid placed in the fluid container. A fluid container covering mates to the open top of the fluid container.

Further referring to FIG. 1, a spring biasing means is used for biasing each needle toward a closed position.

As noted herein, in the disclosed embodiment of the present invention, the source of pressurized gas is a battery powered air compressor and the gas that is output from source of pressurized gas is air. The batteries can comprise one or more disposable batteries or one or more rechargeable batteries, such as NiCad or L-Ion type batteries. Battery 30 is shown as being a modular snap on type that can be removed from the gun body for recharging. In such embodiment, the compressed air pump comprises a motor, a means of transforming angular motion to oscillating linear motion, a piston, a chamber for accepting the piston, and the chamber having valves for accepting air and expelling air.

In one embodiment of the present invention, the fluid container is a single plastic polypropylene paint cup. Alternatively, the fluid container may comprise a single light-weight metal or alloy container, such as an aluminum container. However, the use of a single container is not limiting. By using a plurality of containers feeding paint and catalysts into the junction near the nozzle, the cordless spray gun of the present invention can be adapted to the spraying of fast-drying paint mixtures while preventing the polymerization of the paint mixture in a single paint container.

Figure 2:
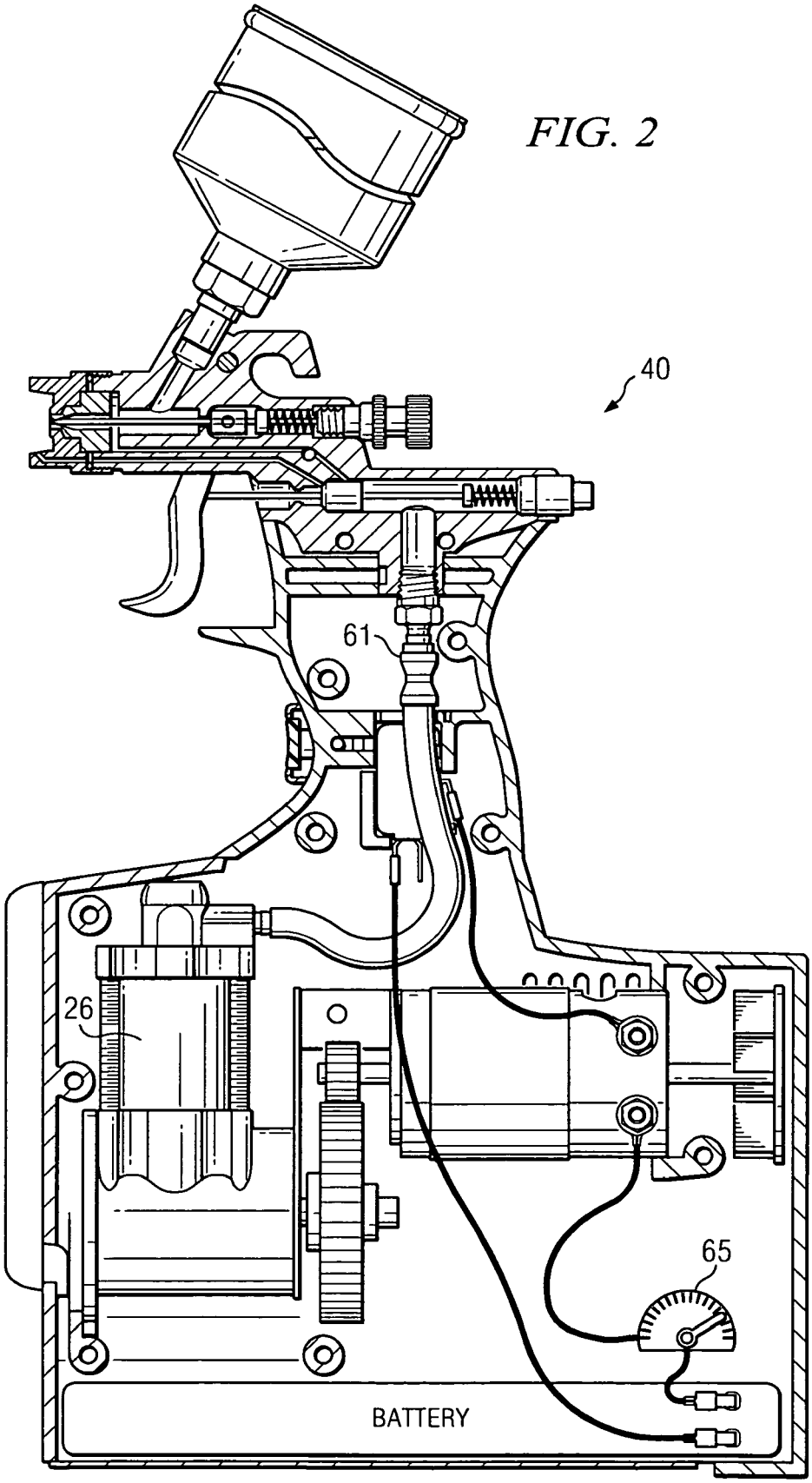
FIG. 2 depicts a cut-away side view of an alternate embodiment of the cordless, self-contained, handheld spray gun of the present invention.

Turning next to FIG. 2, there is shown an alternate embodiment of the present invention. The embodiment illustrated in FIG. 2 does not include a reservoir, but provides pressurized gas or air from the compressor assembly 26 through a single tube assembly to 40 spry gun head. To avoid potential sputtering of the fluid while painting due to the compressor operation, single tube assembly may be fitted with flow regulator 61, which is a narrowing to regulate the variances of pressure and air flow from the compressor. Further illustrated in FIG. 2 is variable regulator 65 to regulate the pressure from compressor assembly 26 by use of a variable resistor, potentiometer, or the like.

While the invention has been described in the specification and illustrated in the drawings with reference to one or more preferred embodiments, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims. For example, the present invention can be tailored to allow the application of fluids with varying viscosities, such as paints, primers, stains, varnishes, sealants and the like. In addition, the present invention may be fabricated from any number of components made from materials such as metal, metal alloys, plastic, polypropylene or other similar material. Various alterations, modifications and substitutions can be made to the disclosed invention without departing in any way from the spirit and scope of the invention.

What is claimed is:

1. A self contained, cordless, handheld spray gun, comprising:

a gun body;

a power source internal to the gun body;

a source of compressed gas internal to the gun body;

a gas nozzle assembly with at least one gas nozzle orifice, said gas nozzle assembly able to regulate the gas flow at the gas nozzle orifice;

a tube assembly coupling the source of compressed gas to the gas nozzle assembly;

a container for holding fluids appurtenant to the gun body;

a fluid chamber coupled to the container for holding fluids;

at least one fluid nozzle orifice at an end of the fluid chamber;

a trigger having a first and second stage, the first stage turns on the source of compressed gas and the second stage causes fluid to be released from the fluid chamber through the fluid nozzle orifice at the end of the fluid chamber when actuated; and a regulator for controlling the amount of compressed gas through the tube assembly.

2. The self-contained, cordless, handheld spray gun of claim 1, wherein the container for holding fluids is adapted to hold paint.

3. The self-contained, cordless, handheld spray gun of claim 1, wherein the source of compressed gas is an internal, electrically driven piston pump.

4. The self-contained, cordless, handheld spray gun of claim 1, wherein the gas nozzle assembly further comprises fan nozzle orifices in intercommunication with the tube assembly.

5. The self-contained, cordless, handheld spray gun of claim 3, wherein the power source and the piston pump are powered with one or more rechargeable batteries.

* * * * *